US008393475B2

(12) United States Patent
Hugues et al.

(10) Patent No.: US 8,393,475 B2
(45) Date of Patent: Mar. 12, 2013

(54) POSTAL SORTING MACHINE WITH A CARRIAGE FOR HANDLING MAILPIECES

(75) Inventors: Damien Hugues, Valence (FR); Mathieu Bayon, Valence (FR); Christian Duclot, Ponsas (FR)

(73) Assignee: SOLYSTIC, Gentilly Cedex (FR)

( * ) Notice: Subject to any disclaimer, the term of this patent is extended or adjusted under 35 U.S.C. 154(b) by 438 days.

(21) Appl. No.: 12/677,225

(22) PCT Filed: Dec. 8, 2009

(86) PCT No.: PCT/FR2009/052439

§ 371 (c)(1), (2), (4) Date: Mar. 9, 2010

(87) PCT Pub. No.: WO2010/072936

PCT Pub. Date: Jul. 1, 2010

(65) Prior Publication Data

US 2011/0211939 A1 Sep. 1, 2011

(30) Foreign Application Priority Data

Dec. 23, 2008 (FR) ..... 08 59046

(51) Int. Cl.
*B07C 7/00* (2006.01)

(52) U.S. Cl. ..... 209/630; 209/704; 209/900

(58) Field of Classification Search ..... 209/584, 209/630, 704, 900; 414/789.9
See application file for complete search history.

(56) References Cited

U.S. PATENT DOCUMENTS

| | | | | | |
|---|---|---|---|---|---|
| 3,738,506 | A * | 6/1973 | Cornford et al. | 414/273 |
| 4,014,428 | A * | 3/1977 | Ossbahr | 198/345.3 |
| 4,239,436 | A * | 12/1980 | Wildenaur | 414/276 |
| 4,678,390 | A * | 7/1987 | Bonneton et al. | 414/282 |
| 5,044,877 | A * | 9/1991 | Constant et al. | 414/798.9 |
| 5,174,454 | A * | 12/1992 | Parkander | 209/3.3 |
| 5,379,229 | A * | 1/1995 | Parsons et al. | 700/215 |
| 6,135,697 | A * | 10/2000 | Isaacs et al. | 414/281 |
| 6,201,203 | B1 * | 3/2001 | Tilles | 209/584 |
| 7,080,739 | B2 * | 7/2006 | Guy et al. | 209/630 |
| 2005/0077217 | A1 * | 4/2005 | Hillerich et al. | 209/630 |

FOREIGN PATENT DOCUMENTS

| | | | |
|---|---|---|---|
| EP | 1 757 374 | A1 | 2/2007 |
| FR | 2 902 676 | A1 | 12/2007 |
| WO | 2007/093189 | A1 | 8/2007 |

* cited by examiner

*Primary Examiner* — Joseph C Rodriguez
(74) *Attorney, Agent, or Firm* — Sughrue Mion, PLLC

(57) ABSTRACT

A sorting machine for sorting mailpieces such as letters and flats, said machine having at least one row of sorting outlets (3) and a trolley for handling the mailpieces as a stack outside the sorting outlets. The trolley is mounted to slide on the machine along said row of sorting outlets and carries a deck that is substantially horizontal and that is mounted to move in rotation relative to the trolley (8) about a vertical axis so as to take up at least two angular positions that are offset from each other by 90 degrees.

5 Claims, 3 Drawing Sheets

POSTAL SORTING MACHINE WITH A CARRIAGE FOR HANDLING MAILPIECES

CROSS REFERENCE TO RELATED APPLICATION

This application is a National Stage of International Application No. PCT/FR2009/052439 filed Dec. 8, 2009, claiming priority based on French Patent Application No. 0859046, filed Dec. 23, 2008, the contents of all of which are incorporated herein by reference in their entirety.

The invention relates to a postal sorting machine for simultaneously sorting different categories of mailpiece such as letters and large-format articles or "flats". The postal sorting machine comprises at least one row of sorting outlets and a trolley for manually handling the mailpieces as a stack outside the sorting outlets.

As is well known in postal sorting, a postal sorting machine comprises a feed inlet with an unstacker for putting the mailpieces into series, an image acquisition system for automatically reading addresses, and a conveyor that directs the mailpieces towards sorting outlets as a function of the addresses that are read and as a function of the sorting plan. For example, the sorting outlets are stacking devices or "stackers" in which the mailpieces are stacked on edge in a certain longitudinal direction one behind another to form a stack. Alternatively, the sorting outlets can, for example, be constituted by racks into which the mailpieces fall by gravity from a bin carrousel, or into which said mailpieces are directed by a routing flap when the mailpieces are conveyed flat.

In order to prepare a single delivery round or "postman's walk" that contains both letters and also flats, it is generally necessary to process the mailpieces in a plurality of sorting passes and thus to recirculate them into the inlet of the machine. It can also be necessary to merge the flats manually into a stack of letters, the flats and the letters being stored in superposed sorting outlets of the machine. Currently, in order to perform such merging, for example, the sorted letters contained in a sorting outlet are emptied into storage trays. Said trays are transferred to sorting racks. The same procedure is followed for the flats that are then inserted manually depending on their points of delivery into the stacks of letters that are already sorted in the sorting racks. Manually transferring the mailpieces into trays and then into racks involves a large number of handling operations that might give rise to breaks in the sequence of the successive sorted mailpieces. In addition, an increase in the number of manual operations gives rise to a significant increase in the costs associated with delivery.

An object of the invention is thus to propose a sorting machine with a trolley for handling mailpieces that is ergonomic, and that facilitates recirculation and merging of the flows of mailpieces for the purpose of preparing the delivery round.

To this end, the invention provides a sorting machine for sorting mailpieces such as letters and flats, said machine having at least one row of sorting outlets and a trolley for handling the mailpieces as a stack outside the sorting outlets, said sorting machine being characterized in that the trolley is mounted to slide on the machine along said row of sorting outlets and carries a deck that is substantially horizontal and that is mounted to move in rotation relative to the trolley about a vertical axis so as to take up at least two angular positions that are offset from each other by 90 degrees.

In a particular embodiment of the invention, the deck comprises a guide ramp, a horizontal platform, and a sloping support wall serving as a sloping-top desk, the horizontal platform being interposed between the sloping wall and the guide ramp, said desk being arranged to take up an angular position in which the guide ramp follows on from and in continuity with the sorting outlet so as to enable the mailpieces to be moved as a stack by being slid from the sorting outlet to the platform of the deck.

In a particular embodiment of the invention, the deck takes up a third angular position that is offset by 90 degrees relative to one of said two angular positions.

The sorting machine of the invention may also have the following features:

- the guide ramp of the top deck is provided with a substantially horizontal slide sill along at least one of its edges so as to provide the continuity with a sorting outlet;
- the trolley is provided with an angular locking abutment for angularly locking the top deck in said angular positions; and
- the trolley carries a handle on which to hang a bag serving to contain the mailpieces in the order required for the delivery round.

The invention can be understood more clearly on reading the following description with reference to the accompanying drawings. This description is given merely by way of indication, and is in no way limiting on the invention. In the drawings.

Figure 1:
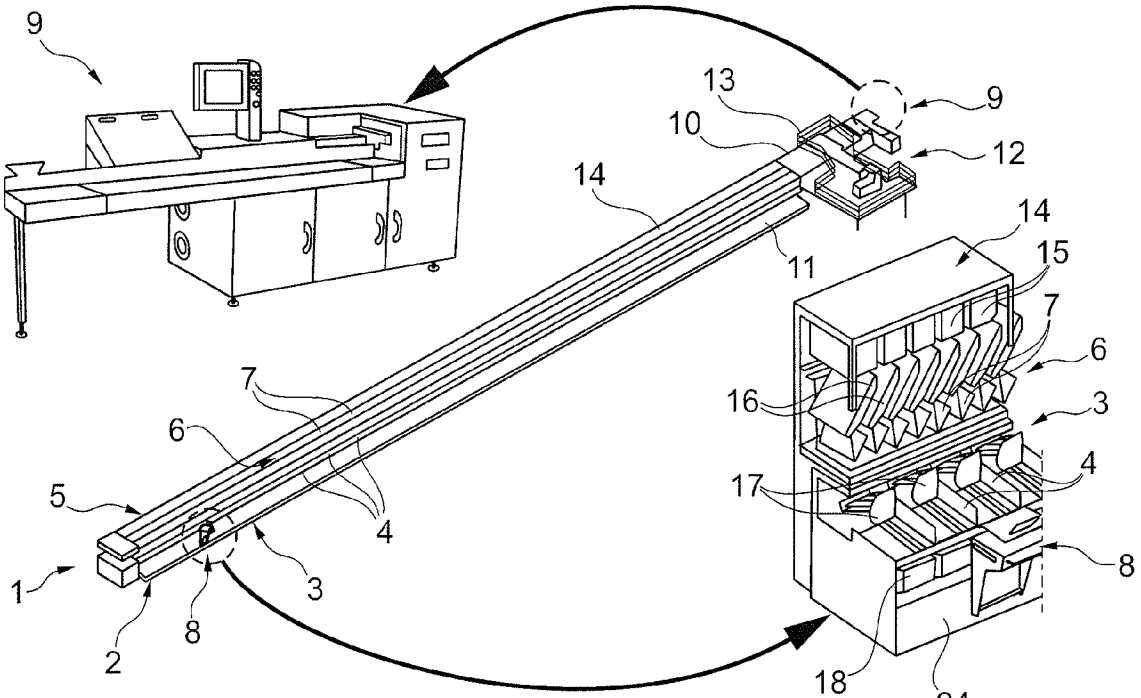
FIG. 1 is a diagrammatic perspective view of a postal sorting machine of the invention.

FIG. 1 shows an example of a sorting machine 1 of the invention. In this example, the sorting machine 1 comprises a first sorting system 2 equipped with sorting outlets 3 having stackers 4 for sorting letters and a second sorting system 5 equipped with sorting outlets 6 having racks 7 for sorting flats. The first sorting system 2 is disposed below the second sorting system 5.

In the detail in FIG. 1, it is shown that the sorting outlets 3 and 6 extend along the machine to form rows of sorting outlets. The trolley 8 that is mounted to move along said sorting outlets is also shown. In particular, the row of sorting outlets 3 having stackers 4 is disposed below the row of sorting outlets 6 having racks 7, so that each sorting outlet 3 of the first system 2 is aligned vertically with a sorting outlet 6 of the second sorting system 5.

In conventional manner, the first sorting system 2 comprises a feed inlet equipped with an unstacker 9 for putting the mailpieces into series, an acquisition system 10 for automatically reading the delivery addresses, and a conveyor device 11 for conveying the mailpieces towards sorting outlets 3 having stackers 4.

In a stacker 4, the mailpieces are stacked on edge one behind another to form a stack. The stack of mailpieces is held by a movable paddle 17 that can be raised to extract mailpieces from the stack of mailpieces.

The second sorting system 5 also comprises a feed inlet equipped with an unstacker 12 for putting the mailpieces into series, an acquisition system 13 for automatically reading the postal address, and a bin carrousel 14 for directing the mailpieces towards sorting outlets 6 having racks 7. The unstacked mailpieces are injected into a bin 15 of the bin carrousel 14. Since the bin carrousel 14 defines a closed-loop path above the sorting outlets 6 having racks 7, the mailpieces conveyed by the carrousel are dropped under gravity from the bins 15 towards the racks 7 merely by opening the bottoms of the bins.

The first sorting system 2 may be adapted to sorting a spectrum of mailpieces of the "letters" type up to the C4 format as defined in the ISO-269 Standard, and preferably of a thickness less than 10 millimeters (mm). The second sorting system 5 can be a machine equipped with a bin carrousel with sorting outlets having racks adapted to storing mailpieces of the "flats" type.

Advantageously, the sorting system 2 having stackers for sorting letters, and the sorting system 5 having racks for sorting flats are arranged relative to each other in a manner such that their sorting outlets are put in register with one another. This means that each rack is disposed in vertical alignment with a corresponding stacker 7. Logical correspondence is also established by the sorting plan that assigns the same points of delivery to a rack and to the corresponding stacker.

In the detail of FIG. 1, an arrangement of sorting outlets is shown in which two racks disposed horizontally in adjacent manner correspond to the width of the stacker, i.e. two racks are aligned vertically with one stacker. Under these circumstances, the sorting plan assigns the same points of delivery to each of the two racks and to the corresponding stacker. This special arrangement makes it possible to alternate the racks so as to perform the sorting at the same time as the merging of the mailpieces.

Figure 2:
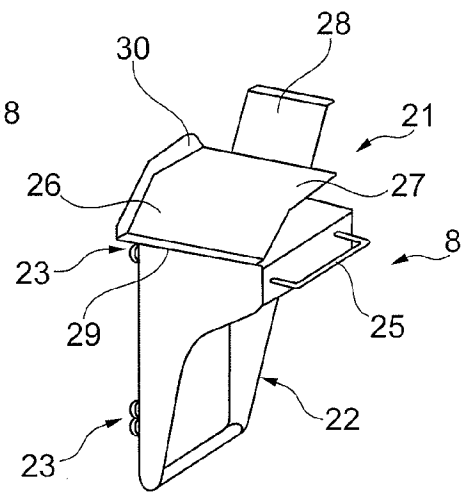
FIG. 2 is a perspective view of the detail of the trolley.

FIG. 2 shows the trolley 8 designed for recirculating and merging the mailpieces contained in the sorting outlets 3 and 6 of the machine 1.

The trolley 8 carries a top deck 21 mounted to move in rotation on a frame 22 about a vertical axis.

The frame 22 comprises a guide structure 23 co-operating with guide means 24 fastened to the sorting machine to move the trolley by sliding it along the rows of sorting outlets. The guide structure 23 is, for example, made up of two rows of free wheels situated at different heights on the frame. And the guide means 24 are, for example, made up of two rails extending along the sorting outlets under the stackers and disposed at heights corresponding to the rows of wheels of the guide structure. The wheels engage in the rails for guiding the trolley 8 along the sorting outlets.

Advantageously, such a trolley does not rest on the floor. It is thus independent of the evenness of the floor of the sorting center. As a result, the top deck 21 is aligned exactly with the outlets having stackers over the entire length of the machine 1.

Furthermore, the frame is equipped with a handle 25 on which to hang a bag designed for containing the delivery round after the mailpieces have been merged.

Figure 4:
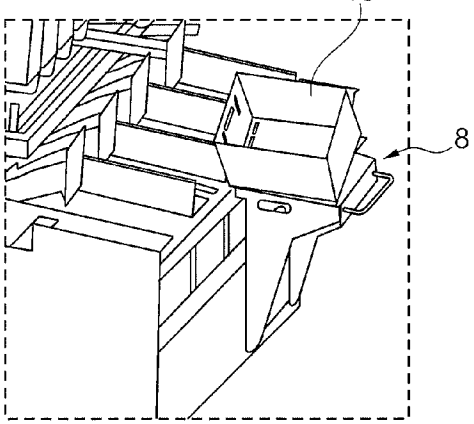
FIG. 4 is a perspective view of the trolley in the position shown in FIG. 3 and as equipped with a storage tray used in recirculation mode.
Figure 5:
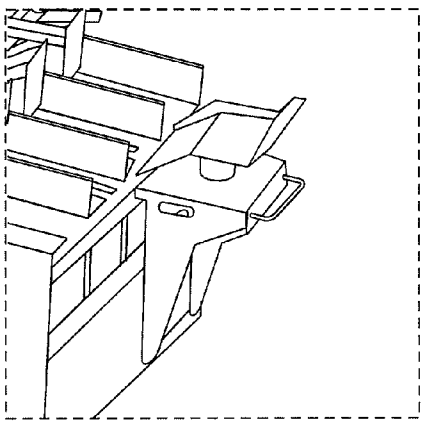
FIG. 5 is a perspective view of the trolley in a second position along the sorting outlets.

The top deck 21 of the trolley 8 comprises a guide ramp 26, a horizontal platform 27, and a support wall 28. The horizontal platform is interposed between the sloping wall and the guide ramp. The guide ramp 26 disposed at one end of the horizontal platform 27 slopes downwards away from the platform, and, at its bottom end, forms a substantially horizontal slide sill 29 that makes it possible to provide continuity between the stacker and the trolley. This continuity is shown in FIG. 5 in the angular position for transferring mail. In addition, the guide ramp 26 and the slide sill 29 are inclined relative to each other in such a manner as to retain a storage tray resting on the guide ramp 26 as shown in FIG. 4. The support wall 28 is disposed on the other side of the platform 27 from the guide ramp 26. The support wall 28 slopes in the same direction as and away from the guide ramp 26, so as to support the mailpieces disposed on the platform 27. The support wall 28 thus slopes upwards away from the platform 27. The top deck 21 is equipped with a jogging edge 30 that extends vertically upwards, on one side of the guide ramp 26, and that is extended along the side of the platform 27.

For example, the horizontal platform measures about 250 mm by 400 mm. The guide ramp 26 measures about 180 mm by 400 mm and it slopes at about 60° relative to the horizontal platform. The support wall 28 measures about 170 mm by 150 mm, and it slopes at about 60° relative to the horizontal platform.

Use of the sorting machine 1 is described below with reference to a sorting method in two sorting passes for preparing the delivery round in compliance with a predefined sorting plan.

In operation, the mailpieces are directed towards the stacker sorting outlet or the rack sorting outlet that corresponds to the point of delivery read off the mailpiece.

In the sorting machine having racks for sorting flats, the management unit (not shown) causes the bottom of a bin to open when said bin is positioned above the rack corresponding to the point of delivery read off the flat contained in the bin. The flat slides on a guide ramp 16 that is inclined relative to the vertical and comes to jog against the bottom of the rack.

In the sorting machine having stackers for sorting letters, the letters are directed by routing flaps (not shown) towards the sorting outlet corresponding to the point of delivery that is read. The letters are stacked on edge one behind another to form a stack.

Figure 3:
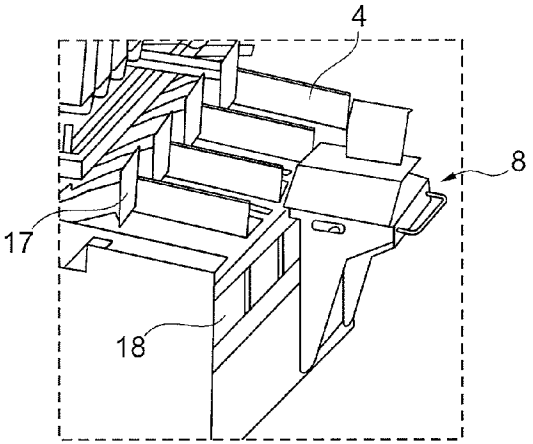
FIG. 3 is a perspective view of the trolley in a first position along the sorting outlets.

At the end of the first sorting pass, the mailpieces must be put into recirculation into the feed inlet of the machine to be subjected to a second sorting pass. For the flow of letters, the mailpieces are placed in a storage tray disposed under the stacker. For the flow of flats, the procedure is as follows. The moving trolley 8 is brought facing the sorting outlet that is to be emptied. The top deck 21 of the trolley 8 is moved in rotation about a vertical axis, and is positioned in a manner such that the guide ramp 26, the platform 27, and the support wall 28 are disposed along the rows of sorting outlets as shown in FIG. 3. This is the tray-support position. The operator is positioned on one side of the trolley, as close as possible to the sorting outlet, with the guide ramp facing the operator. The deck 21 is held in this position by an angular locking abutment (not shown). For example, the locking abutment comprises a spring equipped with a ball at its end. The ball engages in a recess formed by the frame 22 so as to lock the deck 21 angularly in this position.

When the top deck is in this angular position, a storage tray 18 stored on a trolley provided for this purpose is placed on the guide ramp 26 and is held in abutment against the slide sill 29. The storage tray 18 is thus disposed inclined as close as possible to the sorting outlets as shown in FIG. 4. This inclined position of the tray facilitates inserting the mailpieces into the tray and extracting them therefrom.

For emptying the rack sorting machine, the racks 7 are mounted to move in translation along horizontal axes that extend perpendicularly to the direction in which the carrousel is conveyed. Therefore, each rack can be moved between a retracted position in vertical register with the bins for the purpose of receiving the mailpieces from the bins and an extracted position in which the rack is brought above the corresponding stacker for the purpose of emptying the flats from the rack. When the rack is in the retracted position, a space giving access to the stacker is left vacant for the operator. When the rack is the extracted position, the rack is brought to the vicinity of the operator, thereby making it easier for the operator to take hold of the flats that are then placed flat in the bottom of the storage tray 18. The flats are disposed flat because they are of size that is too large for them to be stacked on edge in sufficiently stable manner. The flats are then fed back into the unstacker 12 by moving the tray on the trolley or by placing it on a recirculation conveyor.

In order to empty the flats contained in the racks, use is made of a storage tray 18 positioned on the trolley provided for that purpose. These mailpieces are then disposed flat in the storage tray 18. Storing them flat makes it possible to have a stable stack. Flats tend to flop when they are disposed on edge. The full tray 18 is then fed back into the inlet of the machine to the unstacker 12 for a second sorting pass, e.g. by means of the moving storage trolley that is external to the machine to the unstacker 9, for a second sorting pass. Alternatively, the tray 18 can be disposed on a recirculation conveyor (not shown) that extends between the sorting outlets and the feed inlet of the machine.

In order to empty the mailpieces of the letter type that are contained in the stacker, the operator raises the movable paddle 17 using one hand while holding the front of the stack with the other hand. Then, the operator moves the paddle to the back of the stack of mailpieces of the letter type, i.e. past the stack of letters, and retrieves the stack of mailpieces that is no longer held by the paddle. The letters are disposed vertically in the storage tray. The letters are of size imparting sufficient stability to a stack on edge.

At the end of the second sorting pass, the mailpieces are in sequence in the outlets assigned in compliance with the sorting plan.

For example, in a stacker 4, the mailpieces are disposed one behind another in sequence, i.e. in the order of their points of delivery in the delivery round.

In other words, the mailpieces are grouped together in a stacker per point of delivery. For each point of delivery in a stacker, the mailpieces of the C4 format are placed in front of the letters. The mailpieces of C4 format thus act as separator cards or as visible identifiers for identifying the changes of delivery point in the stack of mailpieces.

In practice, emptying a sorting outlet always begins with emptying the stacker, followed by a step in which the corresponding rack is emptied, and the mailpieces are merged simultaneously. This can be explained by the numbers of mailpieces to be sorted. The number of flats is considerably less than the number of mailpieces of the letter type up to the C4 format. It is therefore plain that the flats should be inserted into the stack extracted from the stacker, rather than the other way round.

In order to empty a stacker of a sorting outlet at the end of the second sorting pass, the moving trolley 8 is brought to face the sorting outlet, and the top deck 21 is placed in a particular angular position. The top deck 21 of the trolley 8 is moved in rotation about the vertical axis and is positioned so that the guide ramp 26, the platform 27, and the support wall 28 are disposed perpendicularly to the rows of sorting outlets as shown in FIG. 5. In other words, the guide ramp 26, the platform 27, and the support wall 28 are situated following on from the stacker, with the slide sill 29 being disposed in continuity with the stacker. With this arrangement, the guide ramp 26 is placed in alignment with and following on from the stacker so as to form a continuous surface.

It should be noted that the guide structure 23 co-operating with the guide rails 24 makes it possible for the guide ramp 26 and each of the stackers to be aligned exactly with each other along the rows of sorting outlets.

The deck 21 is held in this position by the angular locking abutment. In this situation, the ball engages in another recess formed in the frame 22 so as to lock the deck 21 angularly in this new position.

Figure 7:
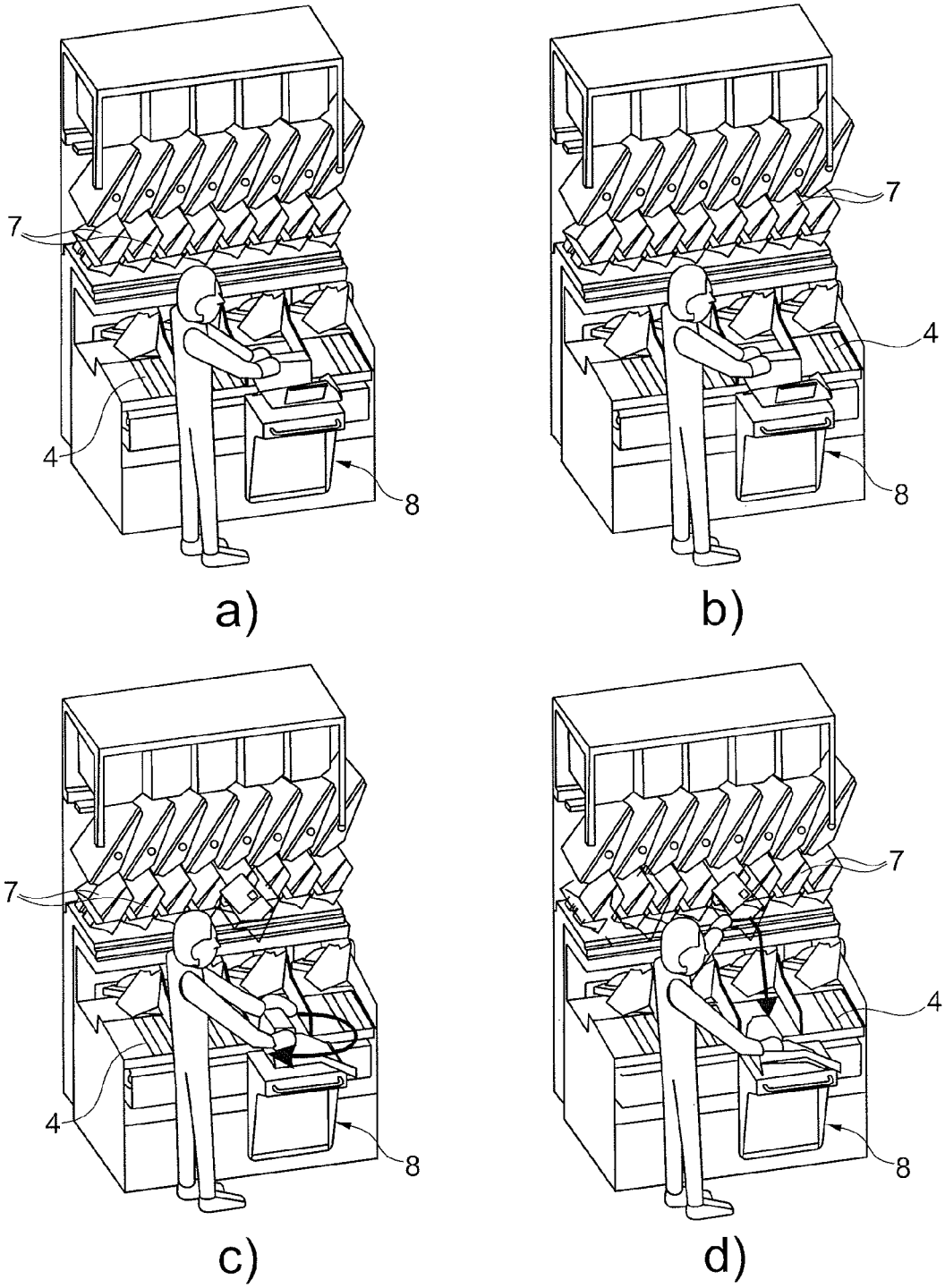
FIG. 7 comprises four perspective views showing the merging steps.

When the top deck is in this angular position, the operator raises the movable paddle 17 with one hand while holding the front of the stack with the other hand. Then, the operator moves the paddle to the back of the stack of mailpieces for the purpose of extracting the mailpieces. The operator holds the stack on edge and causes it to slide over the surface of the stacker, onto and over the guide ramp 26 as shown in FIG. 7*a*), and then onto the platform 27 so that it comes to rest as a stack on edge against the support wall 28 that then serves as a sloping-top desk as shown in FIG. 7*b*). It should be noted that, in this configuration, the addresses on all of the mailpieces face towards the support wall 28. The extracted stack of mailpieces has been subjected to a movement in translation of the stacker towards the wall 28 without any change in the orientation thereof. It should be noted that during this step of emptying the stacker, the operator is placed on one side of the trolley and in the vicinity of the stacker.

Figure 6:
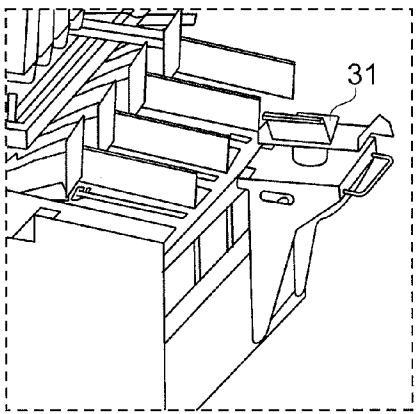
FIG. 6 is a perspective view of the trolley in a third position along the sorting outlets.

The operator then causes the top deck 21 to move in rotation so as to place it in another angular position for the purpose of merging the mailpieces. In this new angular position shown in FIGS. 6 and 7*c*), the guide ramp 26, the platform 27 and the support wall 28 are disposed along the rows of sorting outlets, i.e. at 90° from the angular position shown in FIG. 5. Unlike in the recirculation step of the first sorting pass as shown in FIGS. 3 and 4, the operator is positioned facing the support wall 28. In addition, the deck is held in this position by the locking abutment as described above.

The operator also places a removable lectern-shaped stand 31 behind the stack of mailpieces resting against the support wall 28. The stand 31 shown in FIG. 6 comprises a base and a support wall that is inclined symmetrically relative to the support wall 28 of the trolley when the base of the stand is resting on the platform 27.

The operator then tips the stack of mailpieces over so that said stack rests against the support wall of the stand 31. In this configuration, a stable stack of mailpieces on edge is situated in front of the operator with the addresses on the mailpieces facing said operator, the mailpieces of the C4 format indicating the changes in points of delivery. In addition, the operator is positioned such that said operator can view the addresses on the sorted flats in the racks. The operator being in this position makes it easier to merge the mailpieces.

The rack is moved from the retracted position in vertical register with the bins towards the extracted position above the corresponding stacker. The operator takes hold of the flats in the rack, reads the postal address on the flat and inserts it in the position corresponding to its point of delivery in the stack of mailpieces disposed on the platform of the trolley. This operation is shown in FIG. 7*d*).

The flats are thus merged with the letters up to the C4 format so as to form the delivery round. In addition, the stack of mailpieces formed in compliance with the delivery round is then tipped back over onto the support wall 28. The operator puts an elastic band into place around the stack of mailpieces while encompassing the support wall 28 so as to hold the stack in place, thereby facilitating the handling without hindering extraction of the bundled stack. The delivery round that is formed is stored, for example, in a bag hung from the handle 25. The emptying and merging steps are then repeated for all of the sorting outlets, thereby forming a plurality of delivery rounds.

Advantageously, with a sorting machine of the invention, the operator does not move either for performing the emptying step shown in FIGS. 7*a*) and 7*b*) or for performing the merging step shown in FIGS. 7*c*) and 7*d*).

The invention claimed is:

1. A sorting machine for sorting mailpieces, said machine having at least one row of sorting outlets and a trolley for handling the mailpieces as a stack outside the sorting outlets, wherein the trolley is mounted to slide on the machine along said row of sorting outlets and carries a deck that is substantially horizontal and that is mounted to move in rotation relative to the trolley about a vertical axis so as to take up at least two angular positions that are offset from each other by 90 degrees, wherein the deck comprises a guide ramp, a horizontal platform, and a sloping support wall serving as a sloping-top desk, the horizontal platform being interposed between the sloping wall and the guide ramp, and said desk being arranged to take up an angular position in which the guide ramp follows on from and in continuity with the sorting outlet so as to enable the mailpieces to be moved as a stack by being slid from the sorting outlet to the platform of the deck.

2. The sorting machine according to claim 1, wherein the guide ramp of the top deck is provided with a substantially horizontal slide sill along at least one of its edges so as to provide the continuity with a sorting outlet.

3. The sorting machine according to claim 1, wherein the deck takes up a third angular position that is offset by 90 degrees relative to one of said two angular positions.

4. The sorting machine according to claim 1, wherein the trolley is provided with an angular locking abutment for angularly locking the top deck in said angular positions.

5. The sorting machine according to claim 1, wherein the trolley carries a handle on which to hang a bag serving to contain the mailpieces in the order required for the delivery round.

* * * * *